US011699887B2

(12) United States Patent
Jin

(10) Patent No.: US 11,699,887 B2
(45) Date of Patent: Jul. 11, 2023

(54) CONNECTOR FOR BUS BAR

(71) Applicant: LS ELECTRIC CO., LTD., Anyang-si (KR)

(72) Inventor: Seung Kyun Jin, Anyang-si (KR)

(73) Assignee: LS ELECTRIC CO., LTD., Anyang-si (KR)

( * ) Notice: Subject to any disclaimer, the term of this patent is extended or adjusted under 35 U.S.C. 154(b) by 55 days.

(21) Appl. No.: 17/433,282

(22) PCT Filed: Jul. 11, 2019

(86) PCT No.: PCT/KR2019/008554
§ 371 (c)(1),
(2) Date: Aug. 24, 2021

(87) PCT Pub. No.: WO2020/175750
PCT Pub. Date: Sep. 3, 2020

(65) Prior Publication Data

US 2022/0140551 A1 May 5, 2022

(30) Foreign Application Priority Data

Feb. 25, 2019 (KR) ..... 10-2019-0021857

(51) Int. Cl.
*H01R 25/16* (2006.01)
*H01R 4/48* (2006.01)

(52) U.S. Cl.
CPC ..... *H01R 25/162* (2013.01); *H01R 4/4863* (2013.01)

(58) Field of Classification Search
CPC .. H01R 25/162; H01R 25/164; H01R 25/167; H01R 25/168; H01R 25/16; H01R 4/28; H01R 4/48
(Continued)

(56) References Cited

U.S. PATENT DOCUMENTS 3,180,924 A * 4/1965 Rowe ..... H02G 5/007 174/88 B
3,427,419 A * 2/1969 Findley, Jr. ..... H01H 1/42 200/255

(Continued)

FOREIGN PATENT DOCUMENTS

JP 2010153389 A 7/2010
KR 200407500 Y1 1/2006

(Continued)

OTHER PUBLICATIONS

International Search Report for related International Application No. PCT/KR2019/008554; report dated Sep. 3, 2020; (5 pages).

(Continued)

*Primary Examiner* — Harshad C Patel
(74) *Attorney, Agent, or Firm* — K&L Gates LLP

(57) ABSTRACT

The present disclosure relates to a connector for a bus bar including a bar-shaped finger divided into a central portion, a pair of end portions symmetrically formed on opposite sides of the central portion, and a pair of connecting portions respectively formed between the central portion and the pair of end portions. The connector for a bus bar includes: a plurality of fingers, at least two or more of which are stacked in the thickness direction perpendicular to the longitudinal direction to form one side portion and at least two or more of which are stacked in the thickness direction to form the other side portion disposed opposite to the one side portion; a pair of coil springs, one end and the other end of which is fixed to the one side portion and the other side portion to be arranged at a predetermined distance apart from each other with respect to the central portion of the finger; and a bracket for supporting the one side portion and the other side portion.

13 Claims, 4 Drawing Sheets

(58) Field of Classification Search
USPC ..... 439/214
See application file for complete search history.

(56) References Cited

U.S. PATENT DOCUMENTS 3,723,940 A * 3/1973 Leonard ..... H01H 1/42 439/823
4,445,732 A * 5/1984 Wafer ..... H01H 1/54 439/38
4,655,538 A * 4/1987 Eguchi ..... H02B 11/04 439/246
4,686,334 A * 8/1987 Nebon ..... H02B 11/04 200/255
4,983,132 A * 1/1991 Weidler ..... H01R 25/162 439/786
5,098,318 A * 3/1992 Suter ..... H01H 1/42 200/255
6,024,611 A * 2/2000 Giuseppe ..... H02B 11/04 439/819
7,795,551 B2 * 9/2010 Narayanan ..... H01H 1/42 200/255
8,672,717 B2 * 3/2014 Li ..... H01R 4/4872 439/829
9,236,698 B2 * 1/2016 Ebisawa ..... H01R 4/4863
9,379,489 B2 * 6/2016 Ebisawa ..... H01R 13/15
9,455,515 B2 * 9/2016 Ebisawa ..... H01R 4/48
10,763,609 B2 * 9/2020 Zhang ..... H01R 13/24
11,469,056 B2 * 10/2022 Bossoni ..... H01H 31/32
2010/0317213 A1 12/2010 Andersen et al.

FOREIGN PATENT DOCUMENTS

KR 20140100942 A 8/2014
KR 20170033720 A 3/2017

OTHER PUBLICATIONS

Written Opinion for related International Application No. PCT/KR2019/008554; report dated Sep. 3, 2020; (4 pages).

* cited by examiner

CONNECTOR FOR BUS BAR

CROSS-REFERENCE TO RELATED APPLICATIONS

The present application is a National Stage of International Application No. PCT/KR2019/008554 filed on Jul. 11, 2019, which claims the benefit of Korean Patent Application No. 10-2019-0021857, filed on Feb. 25, 2019, with the Korean Intellectual Property Office, the entire contents of each hereby incorporated by reference.

FIELD

The present disclosure relates to a connector for a bus bar having an improved structure.

BACKGROUND

A bus bar is a conductor for transmitting electrical energy, and is widely used in many fields.

For example, an air circuit breaker in one aspect of a circuit breaker is an industrial power device that blocks a circuit using air as an arc suppression medium when an abnormal current occurs to protect life and utilization equipment, and such an air circuit breaker also includes a bus bar.

Korean Patent Laid-Open No. 10-2013-0036931 (Title of the Disclosure: Isolation Contact Structure for Air Circuit Breaker) discloses an air circuit breaker including such a bus bar.

Specifically, referring to the prior patent above, the conventional air circuit breaker may include a cradle and a circuit breaker body detachably connected to the cradle to be energized.

Here, it is disclosed that in order to energize the cradle and the circuit breaker body, the cradle includes an isolation contact, which is disposed on the cradle so that the front of the cradle is connected to the terminal of the circuit breaker body and the rear of the cradle is connected to the external terminal.

That is, the isolation contact of the prior art performs the function of a connector in which a bus bar, which is a connection terminal, can be connected to both directions of the connector, and such a conventional connector has the following problems.

First, in the conventional connector, the structure in which bus bars are inserted is implemented as a plurality of fingers stacked in the thickness direction, but the shape of these fingers must be manufactured in consideration of the shape in which the leaf spring must be disposed on the outside, so the manufacturing cost may increase.

In addition, since the leaf spring used in the conventional connector must be manufactured in consideration of a structure for imparting individual elastic force to each finger, the manufacturing cost may increase.

In addition, in consideration of the rated voltage or the rated current, the fingers may be stacked in the thickness direction according to the situation. In this situation, if the number of fingers is changed, there is a problem that a leaf spring must be separately manufactured according to the changed width.

In addition, since the shape of the holder, which is a bracket for fixing the finger, is complicated, the manufacturing cost may increase.

In addition, since it takes a long time to manufacture the connector by assembling the individual components having the complex structure as described above, there is a problem that productivity is reduced and maintenance and repair are not easy.

SUMMARY

The present disclosure has been devised to solve the above problems, and is directed to providing a connector for a bus bar that can reduce manufacturing cost and improve assembly and productivity by having a simple structure.

The present disclosure is directed to providing a connector for a bus bar including a bar-shaped finger divided into a central portion, a pair of end portions symmetrically formed on opposite sides of the central portion, and a pair of connecting portions respectively formed between the central portion and the pair of end portions, the connector including: a plurality of fingers, at least two or more of which are stacked in the thickness direction perpendicular to the longitudinal direction to form one side portion and at least two or more of which are stacked in the thickness direction to form the other side portion disposed opposite to the one side portion; a pair of coil springs, one end and the other end of which is fixed to the one side portion and the other side portion to be arranged at a predetermined distance apart from each other with respect to the central portion of the finger; and a bracket for supporting the one side portion and the other side portion.

In addition, the pair of coil springs may be respectively disposed at the pair of connecting portions of the finger.

In addition, at least two or more of the pair of coil springs may be disposed in the thickness direction of the finger.

In addition, a concave groove may be formed on a side surface of the pair of connecting portions and the concave groove may form a fastening hole together with the concave groove of adjacent finger at the one side portion and the other side portion, and opposite ends of each of the pair of coil springs may be inserted into and fixed to the fastening hole.

In addition, opposite ends of each of the pair of coil springs may be bent to form hook portions, and the connector may further include a mounting pin for mounting the hook portions of the pair of coil springs disposed on the outer surface of the one side portion or on the outer surface of the other side portion.

In addition, in the finger, a first seat groove in which a part of the mounting pin can be seated may be formed in the thickness direction.

In addition, the pair of end portions of the finger that face each other at the one side portion and the other side portion may be formed to be round or tapered, respectively.

In addition, the bracket may include a center plate disposed between the one side portion and the other side portion; and a pair of side plates formed extending on opposite sides of the center plate and disposed on both sides of the one side portion and the other side portion.

In addition, a fixing hole may be formed in the pair of side plates, respectively; and the connector may further include a fixing pin penetrating through the fixing holes and disposed on each outer surface of the one side portion and the other side portion.

In addition, in the finger, a second seat groove in which the center plate can be seated may be formed in the thickness direction.

In addition, the pair of side plates may have fastening holes for bolt fastening with a bus bar inserted between the one side portion and the other side portion.

The present disclosure can improve assembling and productivity since the fingers having a mutually symmetrical structure and the coil springs are fixed by means of a mounting pin, and ensure easy assembly and productivity even if the number of fingers is increased or decreased in consideration of the rated voltage or rated current.

In addition, since the present disclosure has a mutually symmetrical structure, assembling to higher level parts such as a cradle can be improved.

BRIEF DESCRIPTION OF THE DRAWINGS

The above and other aspects, features, and advantages of the present disclosure will become more apparent to those of ordinary skill in the art by describing embodiments thereof in detail with reference to the accompanying drawings, in which.

Figure 1:
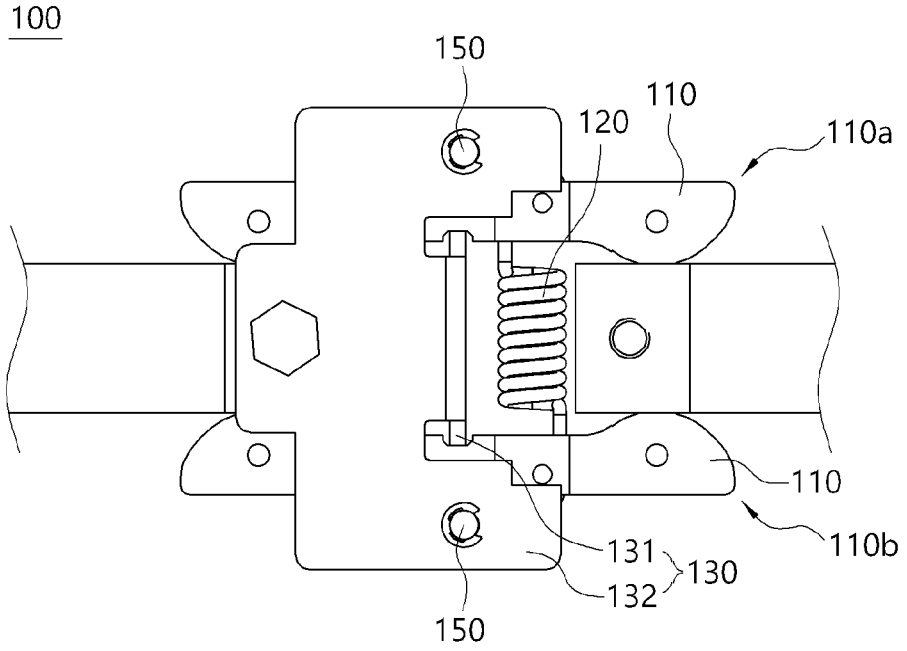
FIG. 1 is a side view showing a state in which bus bars and terminals are respectively fastened to opposite sides of a connector for bus bar according to an exemplary embodiment of the present disclosure.

| Description of Symbols | |
|---|---|
| 100: connector for bus bar | 110: finger |
| 110a: one side portion | 110b: other side portion |
| 110c: fastening hole | 111: central portion |
| 112: a pair of end portions | 113: a pair of connecting portions |
| 114: concave groove | 115: first seat groove |
| 116: second seat groove | 120: a pair of coil springs |
| 121: hook portion | 130: bracket |
| 131: center plate | 132: side plate |
| 132a: fixing hole | 132b: fastening hole |

DETAILED DESCRIPTION

Hereinafter, preferred embodiments of the present disclosure will be described in detail with reference to the accompanying drawings.

Unless defined otherwise, all terms used herein are intended to have the meaning as is commonly understood by one of ordinary skill in the art, and if the term used herein conflicts with the generic meaning of that term, the definition used herein prevails over the generic meaning.

It is to be understood, however, that the following description is intended to illustrate embodiments of the present disclosure and is not intended to limit the scope of the disclosure, and that like reference numerals refer to like elements throughout the specification.

Figure 2:
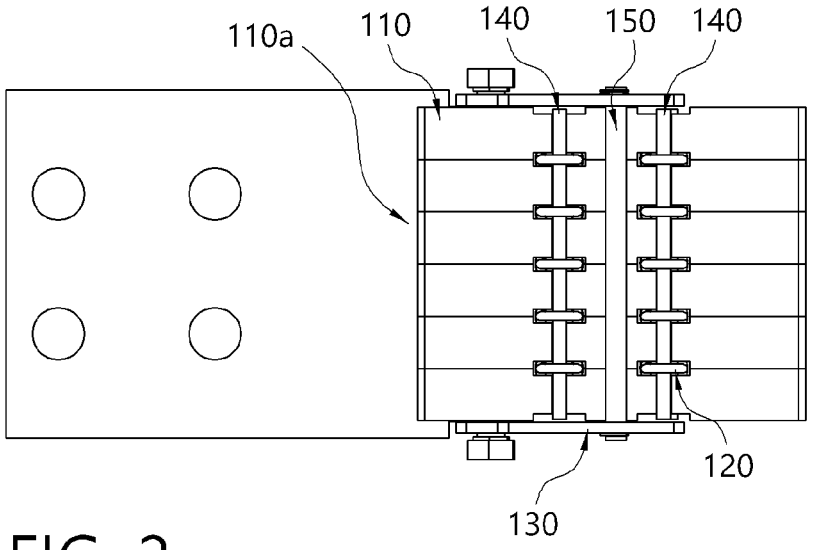
FIG. 2 is a top view of FIG. 1.
Figure 3:
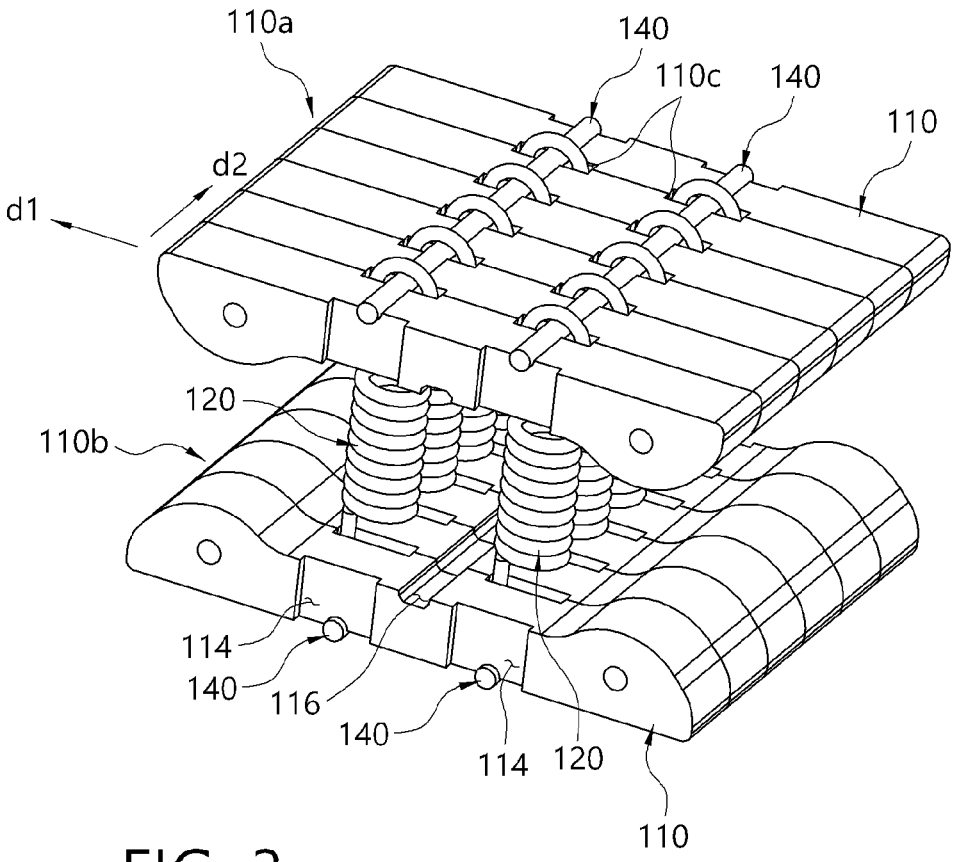
FIG. 3 is a perspective view of the connector for bus bar with a bracket removed therefrom according to an exemplary embodiment of the present disclosure.
Figure 4:
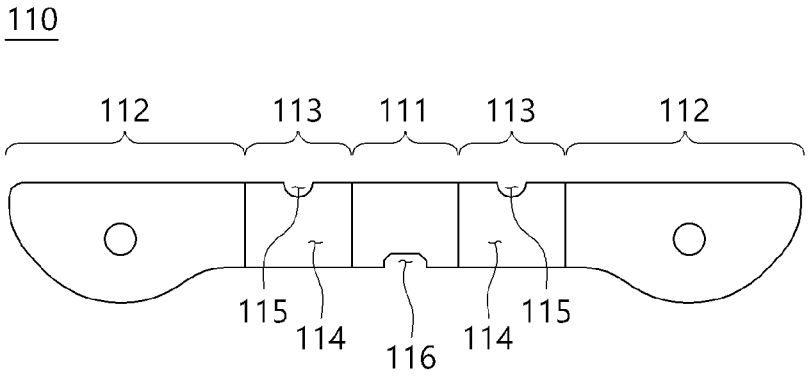
FIG. 4 is a side view of a finger according to an exemplary embodiment of the present disclosure.
Figure 5:
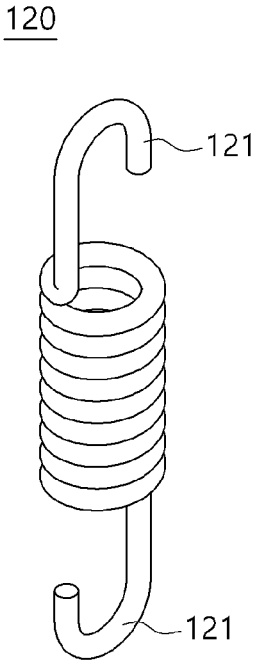
FIG. 5 is a perspective view of a coil spring according to an exemplary embodiment of the present disclosure.
Figure 6:
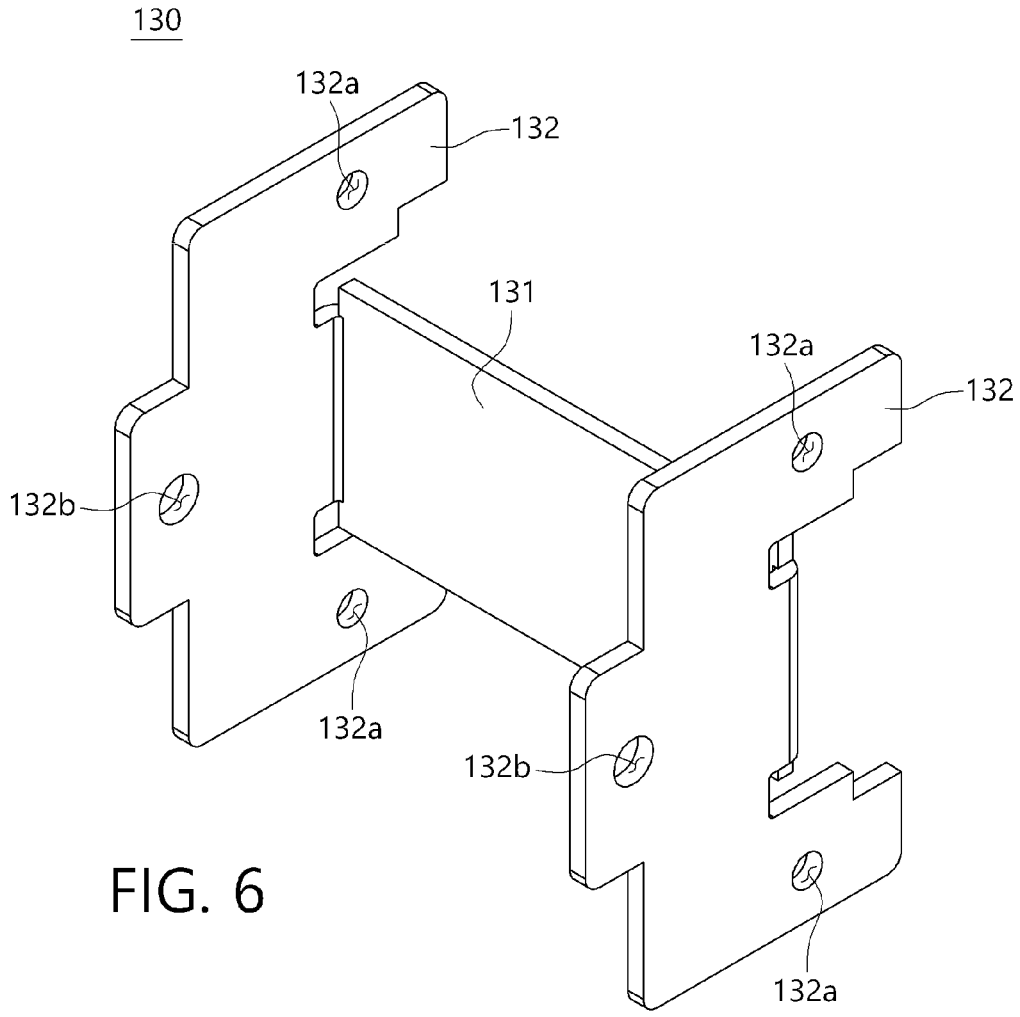
FIG. 6 is a perspective view of a bracket according to an exemplary embodiment of the present disclosure.

FIG. 1 is a side view showing a state in which bus bars and terminals are respectively fastened to opposite sides of a connector for bus bar according to an exemplary embodiment of the present disclosure; FIG. 2 is a top view of FIG. 1; FIG. 3 is a perspective view of the connector for bus bar with a bracket removed therefrom according to an exemplary embodiment of the present disclosure; FIG. 4 is a side view of a finger according to an exemplary embodiment of the present disclosure; FIG. 5 is a perspective view of a coil spring according to an exemplary embodiment of the present disclosure; and FIG. 6 is a perspective view of a bracket according to an exemplary embodiment of the present disclosure.

Referring to FIGS. 1 to 6, a connector for bus bar 100 according to an embodiment of the present disclosure may include a finger 110, a coil spring 120, and a bracket 130, and may further include a mounting pin 140 or a fixing pin 150.

A plurality of fingers 110 may be stacked to form one side portion 110*a* and the other side portion 110*b* of the connector for bus bar 100 according to an embodiment of the present disclosure.

Specifically, the finger 110 has a bar shape, which may be divided into a central portion 111, a pair of end portions 112 symmetrically formed on opposite sides of the central portion 111, and a pair of connecting portions 113 respectively formed between the central portion 111 and the pair of end portions 112.

In addition, the finger 110 in the shape of a bar has a longitudinal direction d1 and a thickness direction d2 perpendicular to the longitudinal directions d1, and when forming the above-mentioned one side portion 110*a* and the other side portion 110*b*, a surface opposite to each other may be defined as an inner surface, an opposite surface of the inner surface as an outer surface, and a surface between the inner and outer surfaces as a side surface.

In this state, at least two or more of the fingers 110 may be stacked in the thickness direction d2, which is a direction perpendicular to the longitudinal direction d1, to form one side portion 110*a*, and at least two or more of the fingers 110 may be stacked in the thickness direction d2 to form the other side portion 110*b* disposed opposite to the one side portion 110*a*.

Here, the one side portion 110*a* and the other side portion 110*b* may be formed as a single member, but the rated voltage or rated current required by the device may be considered by stacking a plurality of fingers 110 as described above.

Therefore, the present disclosure includes the shape and fastening structure of the finger 110 and the elastic member in consideration of easy assembling.

Specifically, in each of the fingers 110 forming the one side portion 110*a* and the other side portion 110*b*, a concave groove 114 may be formed on the side surface of the pair of connecting portions 113, and the concave groove 114 may form a fastening hole 110*c* together with the concave groove 114 of the adjacent finger 110 at the one side portion 110*a* and the other side portion 110*b*.

This fastening hole 110*c* is used as a structure in which the coil spring 120 to be described later is fastened.

In addition, in the finger 110, a first seat groove 115 in which a part of the mounting pin 140 to be described later can be seated may be formed in the thickness direction d2.

This first seat groove 115 may be formed on the outer surface of the finger 110, and may be connected to the first seat groove 115 of the adjacent finger 110 to improve the ease of fastening of the mounting pin 140 to be described later.

In addition, in the central portion 111 of the finger 110, a second seat groove 116 in which a center plate 131 of the bracket 130 to be described later can be seated may be formed in the thickness direction d2.

This second seat groove 116 may be formed on the inner surface of the finger 110, and may be connected to the second seat groove 116 of the adjacent finger 110 to improve the ease and accuracy of fastening of the center plate 131 to be described later.

In addition, the inner surfaces of the pair of end portions 112 of the finger 110 that face each other at the one side portion 110*a* and the other side portion 110*b* may be formed to be round or tapered, respectively, to achieve accurate fastening of the bus bar even if there is a height difference when the connector for bus bar 100 according to an embodiment of the present disclosure is assembled to higher level parts such as a cradle (not shown).

The coil spring 120 may be a pair, one end and the other end of which may be fixed to the one side portion 110*a* and the other side portion 110*b* to be arranged at a predetermined distance apart from each other with respect to the central portion 111 of the finger 110.

This pair of coil springs 120 can be symmetrically disposed with respect to the central portion 111 of the finger 110 to ensure the fastening force of the connector for bus bar 100 according to the embodiment of the present disclosure and the bus bars to be fastened on opposite sides thereof.

Specifically, the pair of coil springs 120 may be respectively disposed at the pair of connecting portions 113 of the finger 110.

In addition, opposite ends of each of the pair of coil springs 120 may be inserted into and fixed to the fastening hole 110*c*.

In addition, the fastening hole 110*c* may be formed in the one side portion 110*a* or the other side portion 110*b* in the thickness direction d2 of the finger 110, so that at least two or more of the pair of coil springs 120 may be disposed in the thickness direction d2 of the finger 110.

The structure in which the pair of coil springs 120 are respectively fixed to the fastening hole 110*c* can be implemented by various known means.

For example, opposite ends of each of the pair of coil springs 120 may be bent to form hook portions 121. In this case, the hook portions 121 of the pair of coil springs 120 may be disposed on the outer surface of the one side portion 110*a* or the outer surface of the other side portion 110*b*, and fixed by the mounting pin 140.

The bracket 130 may support the one side portion 110*a* and the other side portion 110*b*.

Specifically, the bracket 130 may include a center plate 131 disposed between the one side portion 110*a* and the other side portion 110*b*, and a pair of side plates 132 formed extending on opposite sides of the center plate 131 and disposed on both sides of the one side portion 110*a* and the other side portion 110*b*.

The central plate 131 is disposed upright between the one side portion 110*a* and the other side portion 110*b*, and opposite sides thereof may be seated respectively in the second seat groove 116 formed in the central portion 111 of the finger 110.

This central plate 131 may be formed larger than or equal to the distance between the one side portion 110*a* and the other side portion 110*b*, whereby the pair of coil springs 120 may be subjected to a tensile force fixed by the mounting pin 140.

The side plates 132 may be formed as a pair by bending opposite ends of the center plate 131 by approximately 90°.

The pair of side plates 132 may be disposed on both sides of the one side portion 110*a* and the other side portion 110*b*, and a fixing hole 132*a* may be formed therein respectively.

The fixing hole 132*a* may be formed to correspond on the outer surface of the central portion 111 of the finger 110, and the connector for bus bar 100 according to an embodiment of the present disclosure may further include a fixing pin 150 penetrating through the fixing holes 132*a* and disposed on each outer surface of the one side portion 110*a* and the other side portion 110*b*, thereby supporting the outer surface of each of the one side portion 110*a* and the other side portion 110*b*.

In addition, the pair of side plates 132 may have fastening holes 132*b* for bolt fastening with a bus bar inserted between the one side portion 110*a* and the other side portion 110*b*.

The assembly process of the connector for bus bar 100 according to the embodiment of the present disclosure is as follows.

First, a plurality of fingers 110 are stacked in the thickness direction d2 to form one side portion 110*a* and the other side portion 110*b*.

Thereafter, the center plate 131 is disposed between the one side portion 110*a* and the other side portion 110*b*, the pair of coil springs 120 are inserted into the fastening hole 110*c* formed in the one side portion 110*a*, and then each hook portion 121 is fixed by the mounting pin 140.

Thereafter, the hook portion 121 is inserted into the fastening hole 110*c* formed in the other side portion 110*b*, fixed by the mounting pin 140, and the fixing pin 150 is inserted.

In short, since the connector for bus bar 100 according to the embodiment of the present disclosure has a symmetrical shape, not only the assembling property is improved, but also there is an advantage that it is possible to easily and quickly vary the size of the connector for bus bar 100 by the fastening structure of the finger 110 and the coil spring 120.

As described above, those skilled in the art will recognize that various changes and modifications can be made without departing from the technical spirit of the present disclosure, and the technical scope of the disclosure should not be limited to the contents described in the embodiments, but should be defined by the claims and their equivalents.

The present disclosure can provide a connector for bus bar that has a simple structure to achieve reduction in manufacturing cost, and improvement in assembling property and productivity, the has industrial applicability.

What is claimed is:

1. A bus bar connector, the bus bar connector comprising:

a plurality of fingers, including a first finger, a second finger, a third finger, and a fourth finger, wherein the first finger is stacked with the third finger to form a first side portion, wherein the second finger is stacked with the fourth finger to form a second side portion;

a plurality of mounting pins, including a first mounting pin, a second mounting pin, a third mounting pin, and a fourth mounting pin; and a plurality of coil springs, including a first coil spring with a first coil ending with a first hook and a second hook on opposing ends of the first coil and a second coil spring with a second coil ending with a third hook and a fourth hook on opposing ends of the second coil, wherein the first coil spring is connected to the first mounting pin via the first hook and the second mounting pin via the second hook, wherein the second coil spring is connected to the third mounting pin via the third hook and the fourth mounting pin via the fourth hook, wherein the first coil and the second coil are disposed between the first side portion and the second side portion and pull the first side portion and the second side portion towards each other via the plurality of mounting pins.

2. The bus bar connector of claim 1, wherein each finger of the plurality of fingers includes a first concave groove and a second concave groove formed on a first side surface, wherein concave grooves of the first finger align with concave grooves of the third finger when stacked to form a first fastening hole and a third fastening hole through which the first hook and the third hook are inserted to interface with the first mounting pin and the second mounting pin, and wherein concave grooves of the second finger align with concave grooves of the fourth finger when stacked to form a second fastening hole and a fourth fastening hole through which the second hook and the fourth hook are inserted to interface with the third mounting pin and the fourth mounting pin.

3. The bus bar connector of claim 1, wherein each finger of the plurality of fingers includes, a first seat groove and a second set groove in which a given mounting pin of the plurality of mounting pins is seated via compressive force from connected coil springs of the plurality of coil springs.

4. The bus bar connector of claim 1, further comprising a bracket that comprises:

a center plate disposed between the first side portion and the second side portion; and first side plate and a second side plate extending on opposite sides of the center plate and disposed on both sides of the first side portion and the second side portion.

5. The bus bar connector of claim 4, further comprising:

a first fixing pin penetrating through first fixing holes defined in the first side plate and the second side plate on a first outer side of the first side portion; and a second fixing pin penetrating through second fixing holes defined in the first side plate and the second side plate on a second outer side of the second side portion.

6. The bus bar connector of claim 4, wherein each finger of the plurality of fingers includes a bracket seat groove in which the center plate is seated via compressive force from connected coil springs of the plurality of coil springs.

7. The bus bar connector of claim 4, further comprising a first bus bar, wherein the first side plate and the second side plate have fastening holes for bolt fastening with the first bus bar inserted between the first side portion and the second side portion.

8. The bus bar connector of claim 4, wherein the center plate is disposed between the first coil spring and the second coil spring.

9. The bus bar connector of claim 1, wherein each finger of the plurality of fingers includes:

a central portion;

a first connecting portion connected on a first side of the central portion;

a second connecting portion connected on a second side, opposite to the first side, of the central portion;

a first end portion connected on a third side to the first connecting portion opposite to where the first connecting portion is connected to the central portion; and a second end portion connected on a fourth side to the second connecting portion opposite to where the second connecting portion is connected to the central portion.

10. The bus bar connector of claim 9, wherein the first end portion and the second end portion are rounded or tapered.

11. The bus bar connector of claim 9, wherein:

the central portion includes a first seating groove defined on a third side, perpendicular to the first side and the second side;

the first connecting portion a includes a second seating groove defined on a fourth side, opposite to the third side; and the second connecting portion a includes a third seating groove defined on the fourth side.

12. The bus bar connector of claim 9, wherein:

the central portion, the first end portion, and the second end portion of each finger have a first thickness;

the first connecting portion and the second connecting portion of each finger have a second thickness, less than the first thickness; and a difference between the first thickness and the second thickness defines two concave grooves in a surface of each finger.

13. The bus bar connector of claim 1, wherein:

the plurality of fingers further includes a fifth finger and a sixth finger, wherein the first finger is stacked with the fifth finger to form the first side portion, wherein the second finger is stacked with the sixth finger to form the second side portion; and the plurality of coil springs further includes a third coil spring with a third coil ending with a fifth hook and a sixth hook on opposing ends of the third coil and a fourth coil spring with a fourth coil ending with a seventh hook and an eighth hook on opposing ends of the fourth coil, wherein the third coil spring is connected to the first mounting pin via the fifth hook and the second mounting pin via the sixth hook, wherein the fourth coil spring is connected to the third mounting pin via the seventh hook and the fourth mounting pin via the eighth hook, wherein the third coil and the fourth coil are disposed between the first side portion and the second side portion and pull the first side portion and the second side portion towards each other via the plurality of mounting pins.

* * * * *